US007076840B2

(12) United States Patent
Ota

(10) Patent No.: US 7,076,840 B2
(45) Date of Patent: Jul. 18, 2006

(54) DRAFT DEVICE

(75) Inventor: Naritoshi Ota, Otsu (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/936,667

(22) Filed: Sep. 9, 2004

(65) Prior Publication Data

US 2005/0072136 A1 Apr. 7, 2005

(30) Foreign Application Priority Data

Oct. 2, 2003 (JP) ..... 2003-344688

(51) Int. Cl.
*D01H 5/00* (2006.01)

(52) U.S. Cl. ..... 19/236

(58) Field of Classification Search ..... 19/236, 19/251, 258, 265

See application file for complete search history.

(56) References Cited

U.S. PATENT DOCUMENTS

| | | | | |
|---|---|---|---|---|
| 3,212,168 A | * | 10/1965 | Sommer | 19/295 |
| 3,381,350 A | * | 5/1968 | Kemmler | 19/258 |
| 4,718,225 A | | 1/1988 | Sanagi | |
| 5,553,357 A | * | 9/1996 | Kim et al. | 19/258 |
| 6,021,548 A | * | 2/2000 | Temburg | 19/150 |

FOREIGN PATENT DOCUMENTS

| | | |
|---|---|---|
| JP | 4-37271 | 3/1992 |
| JP | 07-126926 | 5/1995 |
| JP | 7-126926 | 5/1995 |

OTHER PUBLICATIONS

Office Action from the Japanese Patent Office dated Jan. 31, 2006 in corresponding Japanese Patent Application No. 2003-344688.

* cited by examiner

*Primary Examiner*—Gary L. Welch
(74) *Attorney, Agent, or Firm*—Westerman, Hattori, Daniels & Adrian, LLP

(57) ABSTRACT

It is an object of the present invention to provide a draft device DR including draft rollers which, when a draft device composed of a plurality of draft roller pairs is used, can reduce the adverse effect of associated air currents resulting from the rollers rotating at high speed while maintaining a gripping force and can effectively utilize the associated air currents to suppress the spread of a bundle of fibers L. The present invention provides a draft device DR including a plurality of roller pairs that pull a bundle of fibers L while feeding the bundle downstream, wherein associated air currents resulting from a roller constituting the roller pair are passed through ends of the roller, and gaps are provided which form air passages in which the air currents act as air flows forming a prevention wall that hinders spread of the bundle of fibers fed while being drafted.

3 Claims, 9 Drawing Sheets

FIG. 6

| TEST NO. | A1 | A2 | A3 | A4 | A5 |
|---|---|---|---|---|---|
| TOP ROLLER OUTER DIAMETER<br>RUBBER THICKNESS A | ϕ 33<br>t 4.5 | ϕ 32<br>t 4.0 | ϕ 31<br>t 3.5 | ϕ 30<br>t 3.0 | ϕ 29<br>t 2.5 |
| Ne | 41.1 | 41.1 | 41.2 | 41.4 | 41.3 |
| NONUNIFORMITY RATIO U% | 12.45 | 12.47 | 12.60 | 13.01 | 13.35 |
| THIN (-30%) | 4878 | 4906 | 5049 | 5542 | 5933 |
| (-50%) | 102 | 108 | 121 | 181 | 224 |
| THICK (+35%) | 795 | 786 | 855 | 1051 | 1222 |
| (+50%) | 81 | 88 | 104 | 168 | 203 |
| NEP (+200%) | 197 | 211 | 188 | 188 | 208 |
| HAIRINESS | 3.52 | 3.51 | 3.51 | 3.54 | 3.53 |
| FLUFF 1.0mm | 341 | 332 | 332 | 333 | 348 |
| STRENGTH (cN) | 157 | 159 | 153 | 152 | 150 |
| CV% | 9.8 | 9.6 | 12.1 | 9.1 | 10.5 |
| LOWEST STRENGTH (cN) | 115 | 122 | 86 | 119 | 108 |
| TENACITY (cN/Te) | 10.9 | 11.1 | 10.7 | 10.6 | 10.5 |
| LONGATION PERCENTAGE (%) | 4.2 | 4.3 | 4.2 | 4.2 | 4.2 |
| CV% | 10.1 | 9.6 | 11.5 | 8.6 | 10.7 |

· SPINNING SPEED 350m/min
· STEPS PRESENT (CLEARANCE 1.5mm × WIDTH 7mm)

FIG. 7

| TEST NO. | B1 | B2 | B3 |
|---|---|---|---|
| ROLLER | NO STEP | STEPS PRESENT | |
| WIDTH OF NIP PORTION: H | 32mm | 18mm | 18mm |
| THICKNESS OF RUBBER: A | 3.5mm | 3.5mm | 4.5mm |
| ROLLER DIAMETER | 28mm | 28mm | 30mm |
| YARN QUALITY | | | |
| AVERAGE SINGLE YARN STRENGTH (cN) | 220 | 223 | 228 |
| AVERAGE ELONGATION PERCENTAGE (%) | 6.3 | 6.3 | 6.1 |
| NONUNIFORMITY RATIO U% | 14.25 | 13.58 | 13.21 |
| THIN (−50%/km) | 340 | 183 | 155 |
| THICK (+50%/km) | 275 | 198 | 146 |
| NEP (+280/km) | 77 | 71 | 61 |
| OPERABILITY | | | |
| SLAB CUT (/UNIT · Hr) | 100 | 29 | 20 |
| YARN BREAKAGE (/UNIT · Hr) | 25 | 13 | 7 |
| NEXT PROCESS OPERABILITY | | | |
| WARPER YARN BREAKAGE (NUMBER OF TIMES/1,000,000m) | 10 | 2.7 | 0.17 |

SPINNING SPEED 350m/min

· STEPS PRESENT (CLEARANCE 1.5mm × WIDTH 7mm)

DRAFT DEVICE

FIELD OF THE INVENTION

The present invention relates to a draft device comprising a draft roller that feeds a bundle of fibers (also referred to as a sliver) while pulling the bundle (this operation is also referred to as "drafting").

BACKGROUND OF THE INVENTION

As a conventional draft device, a roller draft device is known which is composed of a plurality of roller pairs that pull a sliver while nipping and feeding the sliver downstream.

Further, the roller draft device has a plurality of roller pairs each composed of a top roller and a bottom roller, and disposed in a direction in which a sliver is fed. For the drafting, the roller pairs are rotated at different rotation speeds so that the rotation speed of one roller pair is slightly higher than that of the preceding one. A draft cradle is disposed which temporarily holds and supports each top roller so that the top roller can be contacted with and separated from the corresponding bottom roller.

The top roller is a rubber roller or a roller covered with rubber. The bottom roller is made of metal. Further, a force that grips the bottom and top rollers is important in reliably drafting the sliver. Accordingly, the top roller is pressed and abutted against the fixedly installed metallic bottom roller.

For example, various spinning devices are well known to manufacture a spun yarn by drafting a sliver (a bundle of fibers). Recently, spinning machines are known which comprise a hollow guide shaft (a hollow spindle) and a spinning nozzle and which can carry out spinning at a high speed of at least 300 m/min. In spinning machines feeding a sliver or a spun yarn at the high speed and represented by the recent ones, drafting is also carried out at a high speed to increase the rotation speed of each draft roller. In particular, the peripheral speed of a front roller that is a feeding roller located at a draft terminal increases significantly. This also increases the adverse effect of associated air currents generated around a peripheral surface of the front roller, which rotates at the high speed. Thus, disadvantageously, the quality of a spun yarn obtained varies and is unstable.

Thus, for the high-speed spinning device, a front top roller for a draft device has been disclosed which has its opposite ends cut by a large length to reduce an effective roller width to about half in order to prevent fibers from being diffused by associated air currents. Further, a draft device has been disclosed in which thin grooves are formed in the front top roller to provide channels for the associated air currents in order to prevent the fibers from being spread by the associated air currents.

The rotation speed of the front roller has been sharply increasing consistently with the speed at which the sliver or spun yarn is fed. Thus, the high speed rotation has often affected even draft devices using a well-known front roller of a grooved roller type.

Specifically, for relatively low spinning speeds used in the prior art, a draft roller composed of a grooved bottom roller and top roller made of rubber has been considered to be suitable for preventing the effect of associated air currents. However, it has been found that at increased feeding speeds, the associated air currents are diffused in a horizontal direction (the axial direction of the roller), thus affecting the physical properties of the spun yarn.

Thus, in the draft device intended to prevent the diffusion of fibers caused by associated air currents, a space or a groove portion is formed to allow the associated air currents to escape in a direction in which the paired front rollers are rotated; the associated air currents otherwise escape in the axial direction from the vicinity of the nip point between the paired front rollers, which rotate at high speed. However, this technique does not positively utilize the associated air currents to align the fibers with one another in the feeding direction, the fibers otherwise escaping in the horizontal direction.

It is an object of the present invention to provide a draft device comprising draft rollers which, when a draft device composed of a plurality of draft roller pairs is used, can reduce the adverse effect of associated air currents resulting from the rollers rotating at high speed while maintaining a gripping force and can effectively utilize the associated air currents to suppress the spread of a bundle of fibers.

SUMMARY OF THE INVENTION

To accomplish this object, a first aspect of the present invention provides a draft device comprising a plurality of roller pairs that pull a bundle of fibers while feeding the bundle downstream, characterized in that gaps are provided at ends of roller constituting roller pair, which are passed through associated air currents resulting from rotation of the roller and form air passages in which said air currents act as air flows forming a prevention wall that hinders spread of the bundle of fibers fed while being drafted.

With the first aspect of the present invention configured as described above, even if fast whirling associated air currents result from the high speed rotation of the rollers, they form fast whirling air currents flowing in the feeding direction of the bundle of fibers from the step portions, formed at the respective roller ends. This serves to suppress the horizontal spread of the bundle of fibers fed while being drafted.

A second aspect of the present invention is characterized in that the gaps are steps formed in one of the rollers constituting the roller pair, and has a clearance of at least 1 mm and at most 3 mm and a width of at least 6 mm.

With the second aspect of the present invention configured as described above, the steps are formed in one of the rollers. It is thus possible to form gaps that reliably feed the fast whirling associated air currents resulting from the high speed rotation of the rollers.

A third aspect of the present invention is characterized in that the roller in which the steps are formed is a rubber roller having a rubber thickness of at least 3.5 mm, and steps of height about 1.5 mm and width about 7 mm are formed at respective ends of the roller.

With the third aspect of the present invention configured as described above, a force that grips the drafted bundle of fibers is maintained. Further, the associated air currents do not disturb the bundle of fibers in spite of the high speed rotation of the rollers.

A fourth aspect of the present invention is characterized in that the draft device is a roller draft device applied to a spinning machine comprising a pneumatic spinning section that generates a spun yarn using whirling air currents.

With the fourth aspect of the present invention configured as described above, the draft device is used in a pneumatic spinning machine capable of spinning at high speed and comprises the front roller which reliably grips the sliver and which does not disturb the surrounding air during high speed rotations.

As described above, according to the present invention, even in a spinning machine that carries out spinning at high speed using a roller draft device, a bundle of fibers is not disturbed which is fed while being drafted by associated air currents resulting from the high speed rotation of rollers. Further, the bundle of fibers is nipped using a gripping force insufficient to cause draft unevenness. This prevents the degradation of the physical properties of a spun yarn.

BRIEF DESCRIPTION OF THE DRAWINGS

FIG. 1 is an enlarged sectional view of a front roller.

FIG. 6 is a table showing yarn physical properties with respect to the thickness of rubber in the front top roller.

FIG. 7 is a table showing comparisons of the yarn physical properties and operability.

DETAILED DESCRIPTION OF THE PREFERRED EMBODIMENTS

The present invention uses the configuration described below to accomplish the object to obtain a draft device comprising draft rollers which can reduce the adverse effect of associated air currents resulting from the rollers rotating at high speed while maintaining a gripping force and can effectively utilize the associated air currents to suppress the spread of a bundle of fibers. Steps are formed at respective ends of one of the rollers constituting a roller pair. Associated air currents resulting from the rotation of the rollers are passed through the steps. Further, the air currents passed through the steps form a prevention wall that hinders the spread of the bundle of fibers fed while being drafted.

With reference to FIGS. 1 to 9, a detailed description will be given to an embodiment of a draft device according to the present invention.

Figure 5:
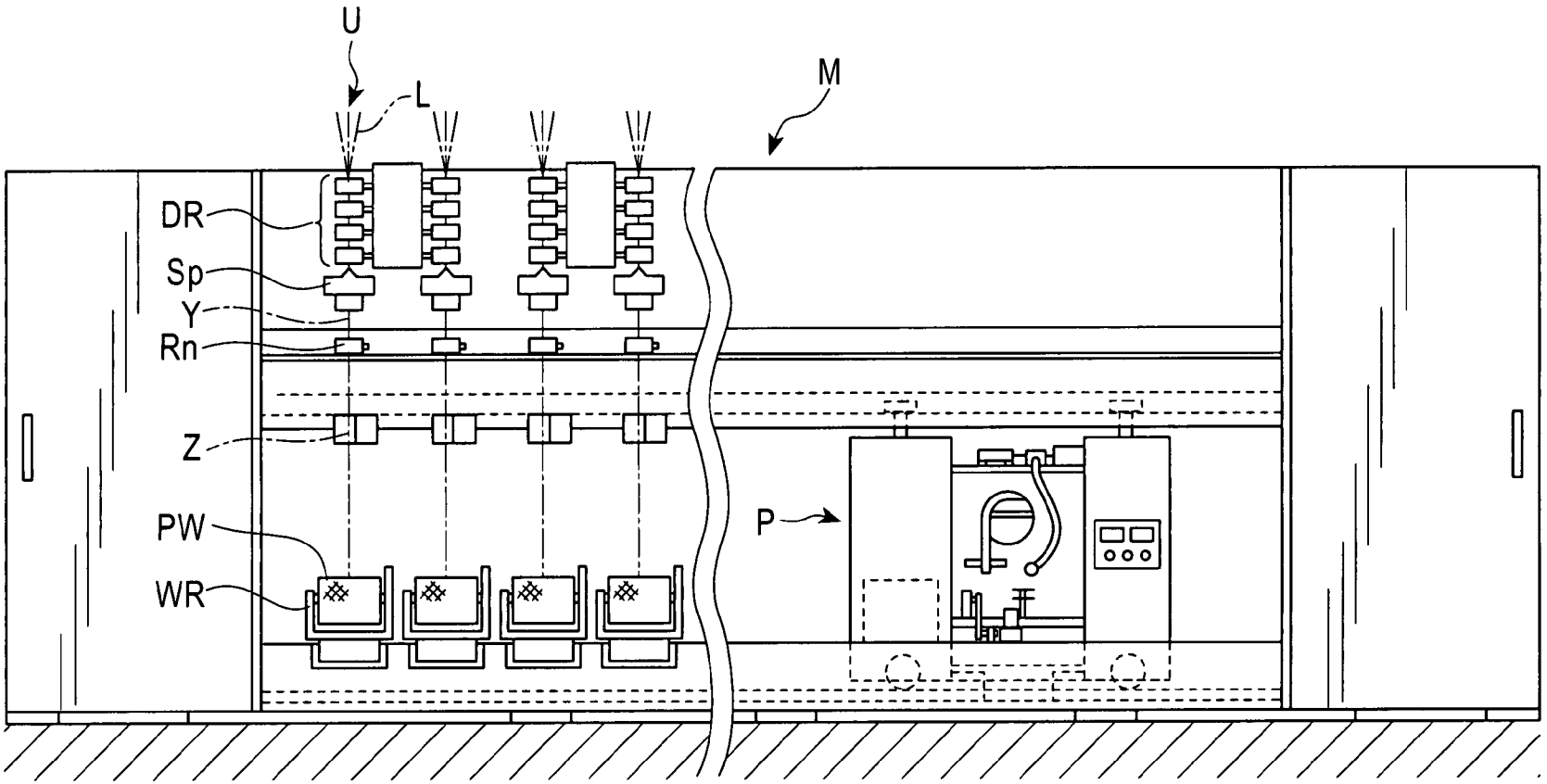
FIG. 5 is a front view of the whole spinning machine.

First, with reference to FIG. 5, a description will be given to a spinning machine M to which the present invention is applied. A large number of spinning units M are arranged in the present spinning machine M. A sliver L is fed to a draft device DR in which a spinning section Sp forms the sliver L into a spun yarn Y. The spun yarn Y passes through a nip roller Rn, a slab catcher Z, and the like and is then wound around a winding section WR to form a package PW. P is a yarn splicing device which splices yarns and which is configured to run inside the spinning machine M at the bottom of it along its longitudinal direction.

Figure 4:
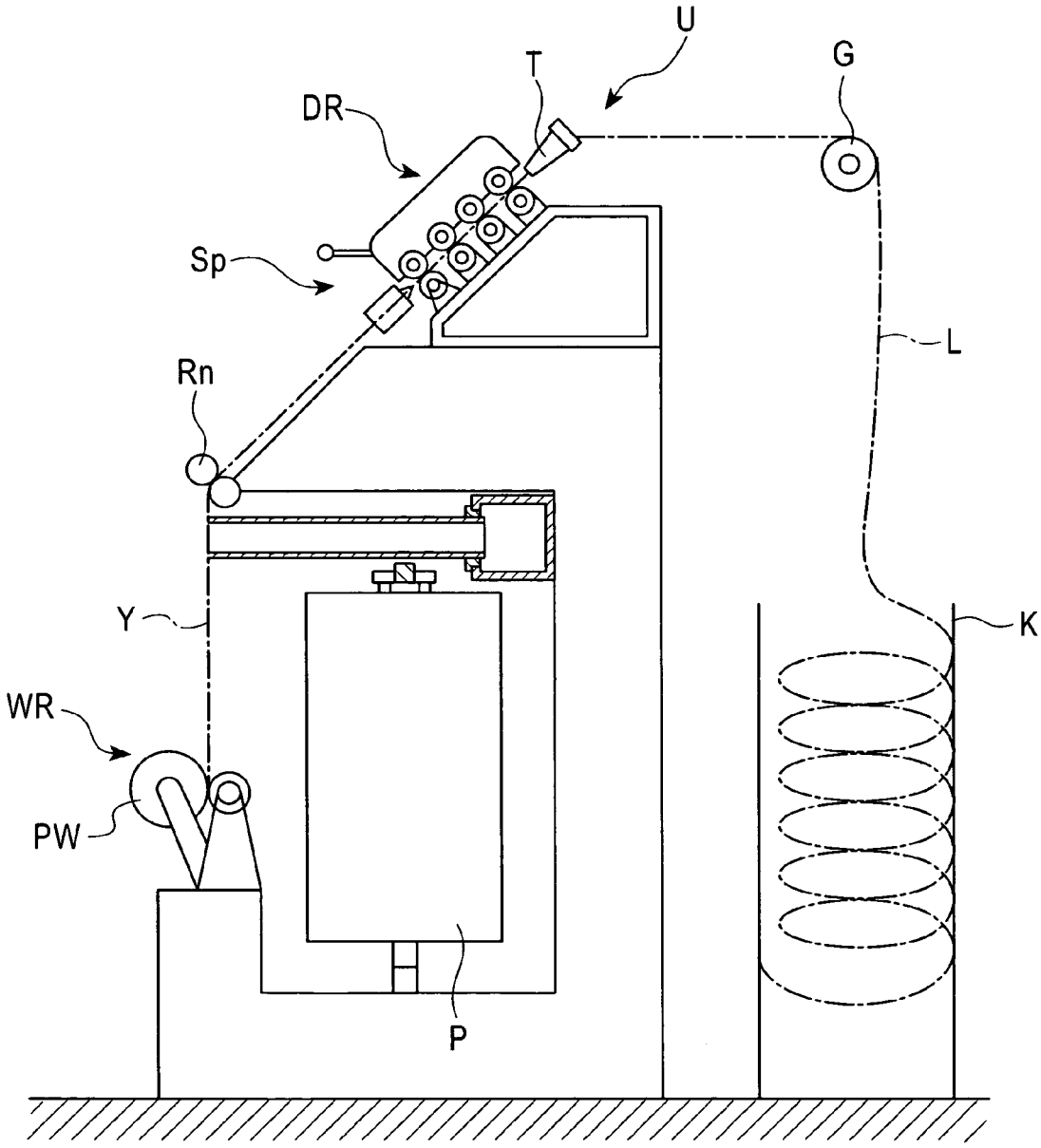
FIG. 4 is a general side view of a spinning machine according to the present invention.

Further, as shown in FIG. 4, the sliver L housed in a can K arranged in the rear of a frame passes through a guide G and a trumpet T and is conveyed to the draft device DR. Then, while passing through a roller draft section in which a feeding speed gradually increases, the sliver L is pulled to a predetermined thickness. The spinning section Sp then forms the sliver L into a spun yarn Y. The spun yarn Y is wound around the winding section WR, located at a front surface of the frame, to form a package PW.

The spinning section Sp is formed of a pneumatic spinning device comprising a spinning nozzle and a hollow guide shaft and which is capable of fast spinning at a spinning speed of at least 300 m/min. However, the present invention is not limited to this aspect. The spinning device may comprise a two-stage pneumatic spinning nozzle. Alternatively, the spinning device may comprise a spinning and paired twisting rollers and may be capable of fast spinning at a spinning speed of several hundred m/min.

Moreover, the present invention is applicable to a draft device such as an other fine spinning frame, a fly frame, or a drawing frame which carries out spinning at high speed.

Figure 3:
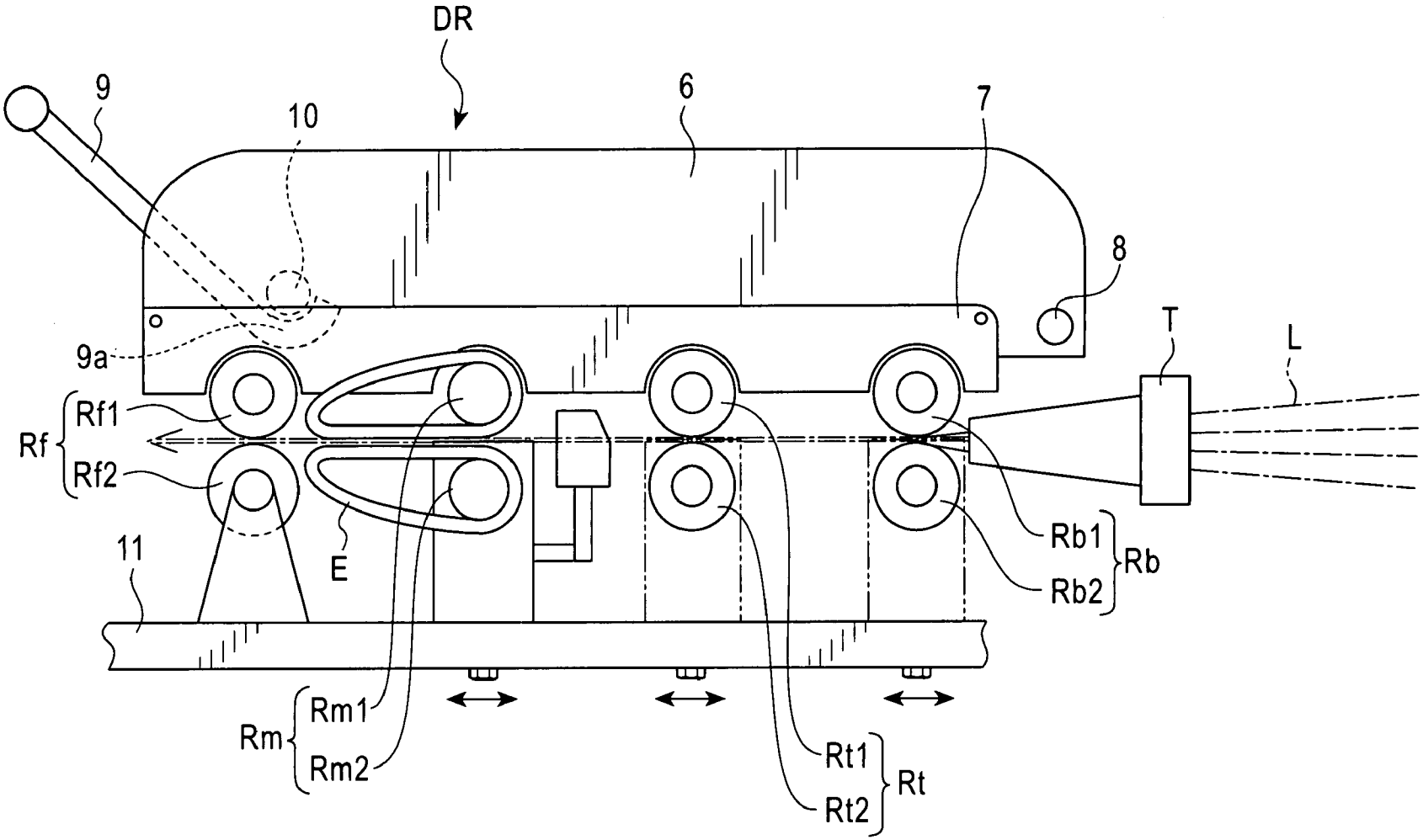
FIG. 3 is a general side view of a draft device.

As shown in FIG. 3, the draft device DR is what is called a 4 line type composed of a back roller Rb, a third roller Rt, a middle roller Rm having an apron belt E, and a front roller Rf. These rollers are arranged along a feeding direction and each of them is composed of a vertical pair of rollers.

The draft device DR drafts the sliver to a predetermined thinness, the sliver being supplied through the trumpet T, that is, a guide through which the sliver L is passed. Drafting is carried out by feeding the sliver L among the rollers, the rotation speed of which gradually increases from the most upstream roller to the most downstream roller. The sliver L drafted to a predetermined thinness is supplied to the spinning section Sp, in which it is formed into a spun yarn Y.

The vertical pair of rollers constituting each roller is composed of a bottom roller disposed in a main body frame of the spinning machine and a top roller configured to freely contact with and separate from the bottom roller.

The top rollers including a back top roller Rb1, a third top roller Rt1, a middle top roller Rm1, and a front top roller Rf1 are integrally installed on a draft cradle 6. When the whole draft cradle 6 moves rotatively using a support shaft 8 as a rotational center, each top roller contacts with or separates from the corresponding bottom roller.

This rotative moving operation is performed by gripping a handle 9. When the draft cradle 6 is lowered, a hook portion 9*a* formed at a lower end of the handle 9 is engaged with a fixed roller 10. This allows the maintenance of the pressure contact between the vertical pair of the top and bottom rollers constituting each draft roller. This configuration is the same as that of a well-known roller draft device.

The distance between the draft rollers depends on the length of fibers constituting the sliver L passed through the rollers while being drafted. This distance is a dimension reexamined every time the quality of the sliver L, a spinning material, is changed. Thus, the front bottom roller Rf2 is fixed to the frame 11, while the middle bottom roller Rm2, the third bottom roller Rt2, and the back bottom roller Rb2 slidably move in the directions of arrows in FIG. 3 with respect to the frame 11 before being fixed at predetermined roller intervals.

Further, a side guide 7 in which predetermined inter-roller pitches are disposed is installed on the draft cradle 6. The top rollers are integrally installed in the side guide 7 in accordance with the predetermined inter-roller pitches. Thus, to change the distance between the top rollers, it is necessary to change to a side guide 7 with new pitches. In this case, the position of the front roller Rf is fixed and can be used as a reference when the distance between the top rollers is changed.

The spinning device uses the draft device DR to draft the sliver L, an aggregate of short fibers, to a predetermined thinness. The spinning device then uses the spinning section to twist the sliver L to form a spun yarn Y. Thus, as the spinning speed increases, the short fibers constituting the sliver L are likely to scatter at the front roller Rf, the final feeding roller of the draft device DR, owing to associated air currents generated around the peripheral surface of the fast rotating front roller. Further, when spinning is carried out with the short fibers scattering, the thickness of the spun yarn Y obtained varies and the yarn quality is degraded.

Figure 1A:
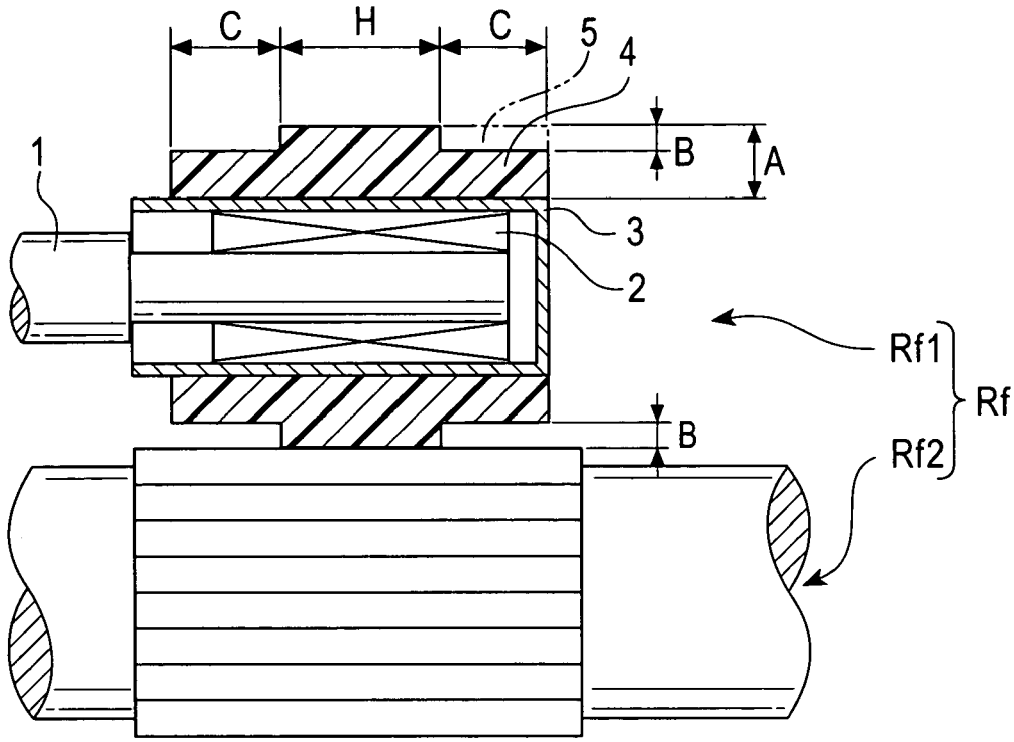
FIG. 1A shows an example in which steps are formed in a top roller.

Now, with reference to FIG. 1A, a description will be given of a draft roller according to the present embodiment in which steps are formed at respective ends of a front top roller that is a rubber roller. The front bottom roller Rf2 is a driving roller that rotatively drives the front top roller Rf1, against which the front bottom roller Rf2 is abutted. The front bottom roller Rf2 is made of metal and comprises horizontal grooves projecting upward by a predetermined height and extending parallel to an axial direction. The front top roller Rf1 is a rubber roller comprising a sleeve 3 installed around a metallic shaft 1 via a bearing 2 and around which a rubber layer 4 is formed. The front top roller Rf1 and the front bottom roller Rf2 thus constitute a draft roller in which the front top roller Rf1 pressed and abutted against the front bottom roller Rf2 rotates in unison with the front bottom roller Rf2 to feed the bundle of fibers nipped between both rollers while gripping the bundle of fibers.

A predetermined gripping force is required to reliably grip the bundle of fibers. When the front top roller Rf1 is pressed against the front bottom roller Rf2, a predetermined amount of the rubber layer 4 of the front top roller Rf1 must be pressed and deformed. Thus, the thickness A of the front top roller Rf1 must have a predetermined value or more.

Moreover, as the spinning speed becomes high and thus the rotation speed of the front roller increase, associated air currents are generated around the peripheral surface of the roller rotating at high speed. Further, the associated air currents generated around the peripheral surface of the roller diffuse in the axial direction (horizontal direction) from the nip point between both rollers. Thus, the bundle of fibers conveyed while being drafted is also diffused in the horizontal direction.

In the present embodiment, to prevent the horizontal diffusion of the bundle of fibers conveyed while being drafted and then fed to the spinning section Sp, steps 5 are formed at respective ends of the front top roller Rf1 so as to form gaps. Accordingly, air currents passing through the gaps form a prevention wall that inhibits the diffusion of the bundle of fibers.

Experiments on spinning and measurements of air flows were carried out by varying the size of the steps. It was then found not only that the associated air currents generated around the peripheral surface of both rollers do not disturb the bundle of fibers but also that a predetermined step size can be used to prevent the diffusion of the bundle of fibers even with the use of the associated air currents.

The clearance B of the gap formed by each of the steps 5 was varied among 0 mm, 0.5 mm, 1.0 mm, 1.5 mm, 2.0 m, 2.5 mm, 3.0 mm, and 3.5 mm. A width C was varied among 5 mm, 6 mm, 7 mm, and 8 mm. Then, the physical properties of the resulting spun yarn were measured. Moreover, the thickness A of the rubber layer was varied among 2.5 mm, 3.0 mm, 3.5 mm, 4.0 mm, and 4.5 mm. Then, comparisons of the yarn physical properties and the air flows were carried out.

As a result, with a spinning machine in which the spinning section Sp comprising the pneumatic spinning device including the spinning nozzle and hollow guide shaft, favorable results were obtained when the clearance B was at least 1 mm and at most 3 mm and when the width was at least 6 mm. Further, in particular, a draft roller in which steps of clearance about 1.5 mm and width about 7 mm were formed was found to produce a spun yarn with stable and favorable yarn physical properties.

This is because, in the spinning device comprising the spinning nozzle provided at the outlet of the front roller Rf and having a suction force, the front roller section is provided with the steps 5, constituting gaps capable of forming air passages in which the associated air currents resulting from the high speed rotation of the front top roller Rf1 and front bottom roller Rf2, constituting the front roller Rf, can be utilized as air flows suppressing the horizontal diffusion of the bundle fibers fed while being drafted.

Figure 1B:
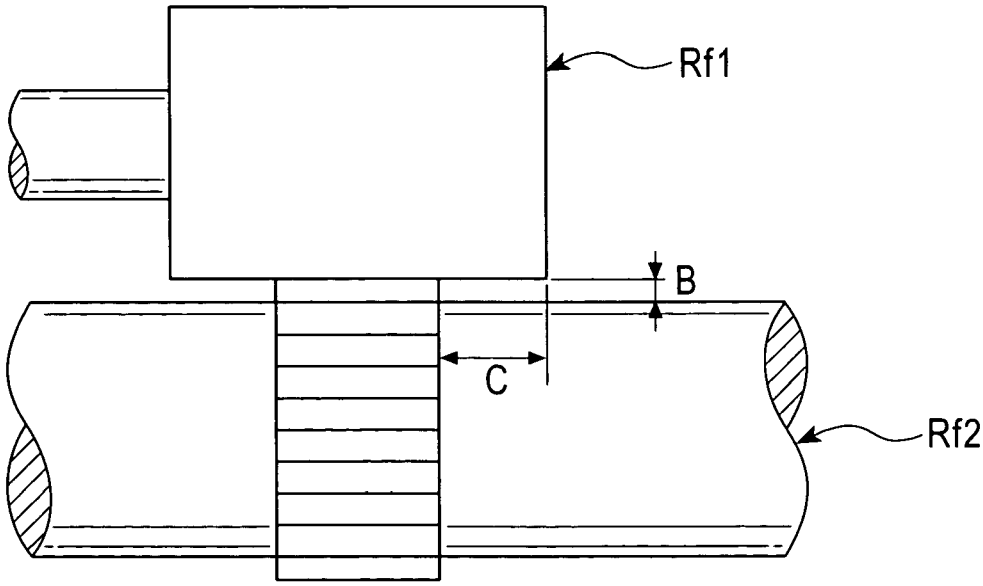
FIG. 1B shows an example in which steps are formed in a bottom roller.

Further, as shown in FIG. 1B, the steps were formed in the front bottom roller Rf2, which is a metallic stripe roller, instead of the front top roller Rf1, which is a rubber roller. Then, comparisons of the yarn physical properties and the air flows were carried out as described above. Similar effects were then found to be produced using gaps of a predetermined size.

Figure 2:
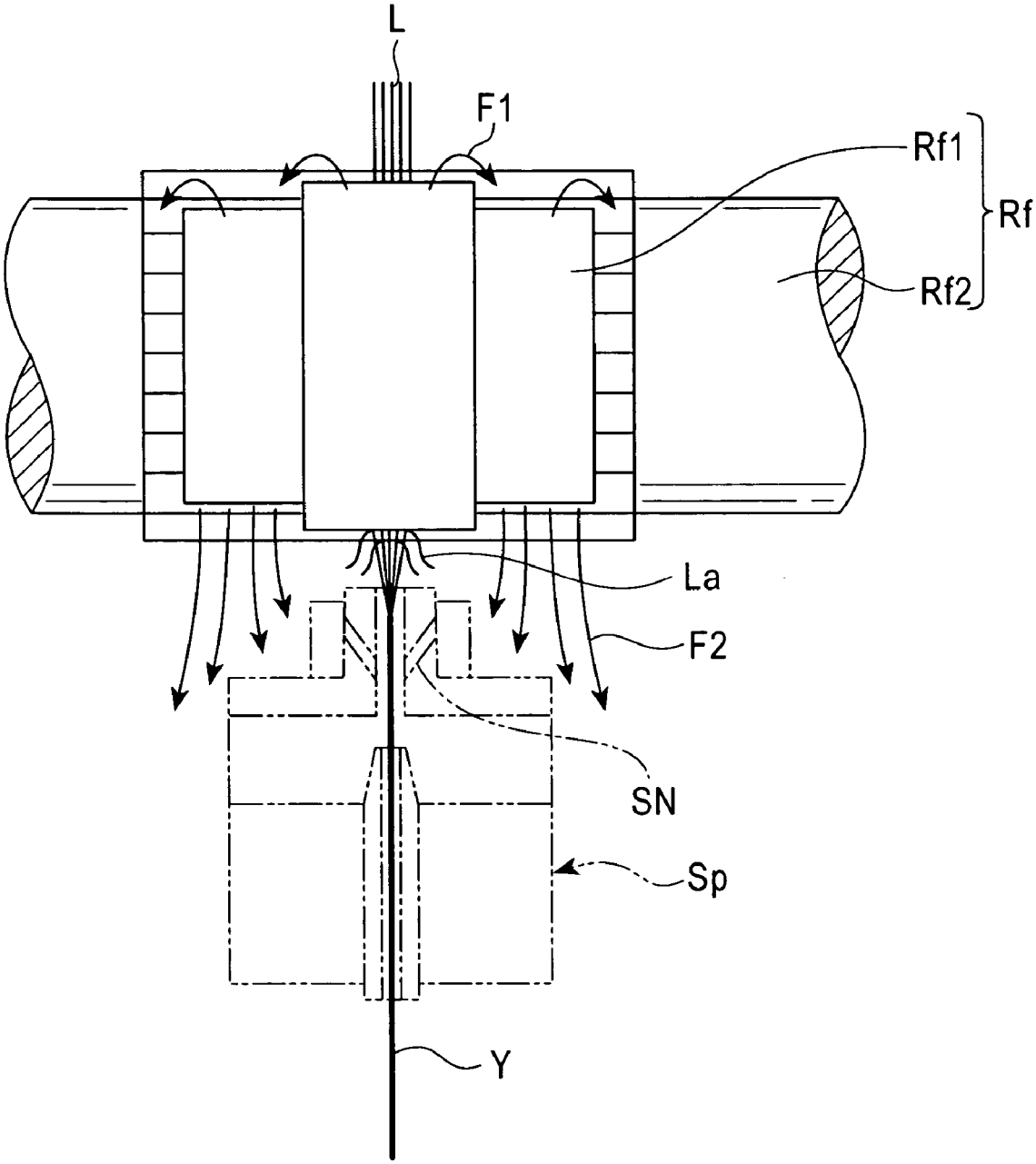
FIG. 2 is a plan view showing an air flow according to the present invention.

The air flows will further be described with reference to FIG. 2. The drafted sliver L is sucked from the outlet of the front roller Rf into a spinning nozzle SN constituting the spinning section Sp by the suction force of the spinning nozzle SN. The spinning section Sp generates a spun yarn Y. At this time, at the outlet of the front roller Rf, some of the short fibers La present at the end of the sliver attempt to diffuse in the horizontal direction. However, since the front roller is provided with the steps 5, associated air currents F1 generated along the peripheral surface of the roller as described above are ejected from the gaps formed by the steps 5. The associated air currents F1 are then fed straight in the direction in which the sliver L advances, to form air currents F2.

Of course, the air currents F2 vary depending on the shape of the gaps formed by the steps 5. However, when spinning is carried out at a high speed exceeding 300 m/min, the formation of air passages of clearance B about 1.5 mm and width about 7 mm makes it possible to generate the air currents F2 suppressing the horizontal diffusion of some short fibers of the sliver L. That is, the air currents F2 form a prevention wall that inhibits the spread of the bundle of fibers fed while being drafted.

Further, a nonuniformity ratio (which indicates the level of unevenness of the yarn in the form of U %) as a physical property of the spun yarn Y may be associated with the diffusion of some fibers or draft unevenness by high speed drafting. To suppress the draft unevenness, it is important to maintain the force exerted by the draft roller section to grip the sliver, at a predetermined value.

Thus, the air currents F2 must not only be formed to suppress the diffusion of some fibers but a predetermined rubber thickness A must be provided in order to maintain the force that grips the sliver. The results of experiments indicate that the spun yarn Y with a low U % was obtained using a rubber thickness of at least 3.5 mm.

With reference to FIG. 6, spun yarns Y obtained by varying the rubber thickness A from 2.5 mm to 4.5 mm will be compared with one another for the physical properties. As is also apparent from the figure, a test A5 (the rubber thickness A is 2.5 mm) results in a U % of 13.35% and a Thin (−50%) of 224. A test A4 (the rubber thickness A is 3.0 mm) results in a U % of 13.01% and a Thin (−50%) of 181. In both tests, U % exceeds 13%. However, tests A3, A2, A1 all result in a U % between 12.0% and 13.0% and a Thin (−50%) of about 100 to 120. This indicates sufficient yarn physical properties are obtained when the rubber thickness A is at least 3.5 mm.

The Thin (−50%) represents the number of parts of the yarn which have a thickness smaller than the average value by at least 50%, the parts being included within a yarn length of 1000 m (1 km). For the thin (−50%), a larger number indicates a larger number of thin parts. That is, a larger number indicates that the spun yarn Y contains a larger number of defective parts resulting from the diffusion of some fibers or the draft unevenness.

The yarn physical properties shown in FIG. 6 resulted from experiments on spinning using the front top roller Rf1 comprising the steps 5 of height (clearance) 1.5 mm and width 7 mm, in the spinning machine having the spinning section comprising the spinning nozzle and the hollow guide shaft and operating at a spinning speed of 350 m/min. Further, under any of the conditions for the tests A1 to A5, in which the rubber thickness of the front top roller Rf1, a rubber roller, was varied, the spun yarn Y exhibited a comparable yarn strength and an equivalent elongation percentage; no differences were observed in these properties. However, differences were observed in numerical values such as the nonunifomity U % and Thin (−50%) which are indicative of the yarn unevenness. This clearly indicates that the yarn unevenness depends on the rubber thickness of the front top roller Rf1.

That is, by forming steps in one of the front top roller Rf1 and front bottom roller Rf2, constituting the front roller Rf, and setting the rubber thickness of the rubber roller at 3.5 mm or more, it is possible to obtain an even spun yarn Y with favorable physical properties even if the spinning is executed at a high speed of at least 300 m/min. Of course, it is allowable to form steps in both rollers so that the whole steps form a gap of a predetermined size.

However, it is preferable to form a gap of a predetermined size by creating steps of a predetermined size in the front top roller Rf1, made of rubber, which is relatively soft, because machining is easier.

FIG. 7 shows data indicating how the presence of the steps improved the yarn physical properties and operability. A test B1 indicates the results of experiments using a front top roller of rubber thickness 3.5 mm having no steps. A test B2 indicates the results of experiments using a front top roller of rubber thickness 3.5 mm having steps of clearance 1.5 mm and width 7 mm on the respective sides of the roller. A test B3 indicates the results of experiments using a front top roller of rubber thickness 4.5 mm having steps similar to the above ones.

As can be seen in the figure, the yarn strength is 220 cN in the test B1, 223 in the test B2, and 228 in the test B3. Accordingly, there is no significant difference in yarn strength between the tested yarns; the yarn strength is comparable among the tested yarns. However, significant differences were observed in the nonuniformity ratio U %, Thin (−50%), and the like. In particular, the value Thin (−50%), indicating excessively thin parts, is 155 in the test B3 but 340 in the test B1, which is more than twice worse than the value in the test B3. Thus, significant differences are observed in operability such as the number of times that yarn breakage occurs during spinning (7 times in the test B3 and 13 times in the test B2 but 25 times in the test B1) and the number of times that yarn breakage occurs during a warper process following a spinning process. In any case, without the steps (the case of the test B1), yarn breakage occurs extremely frequently, thus degrading the operability.

Figure 8:
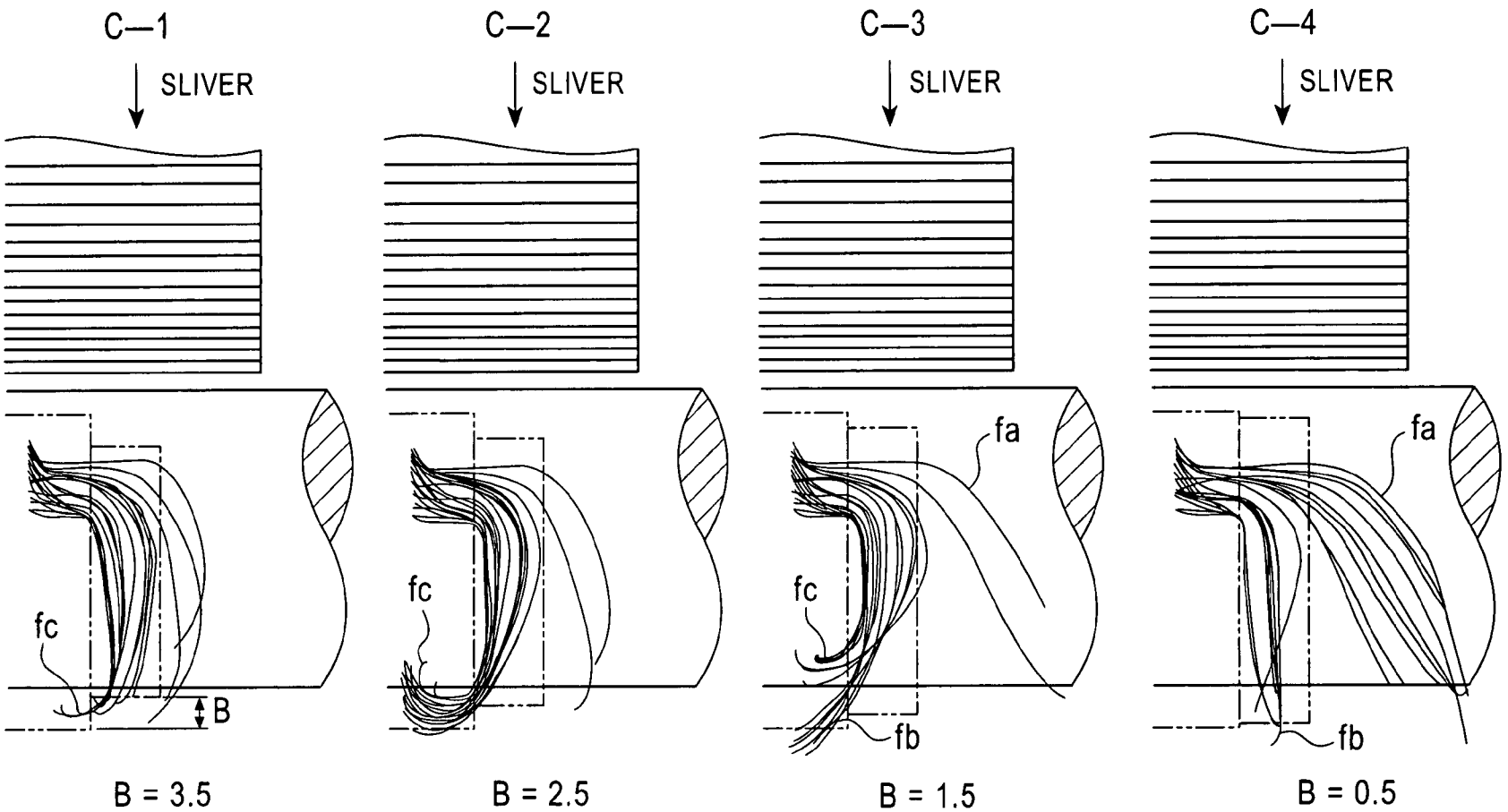
FIG. 8 is a view of the results of simulation of associated air currents resulting from a front roller Rf that rotates at high speed.
Figure 9:
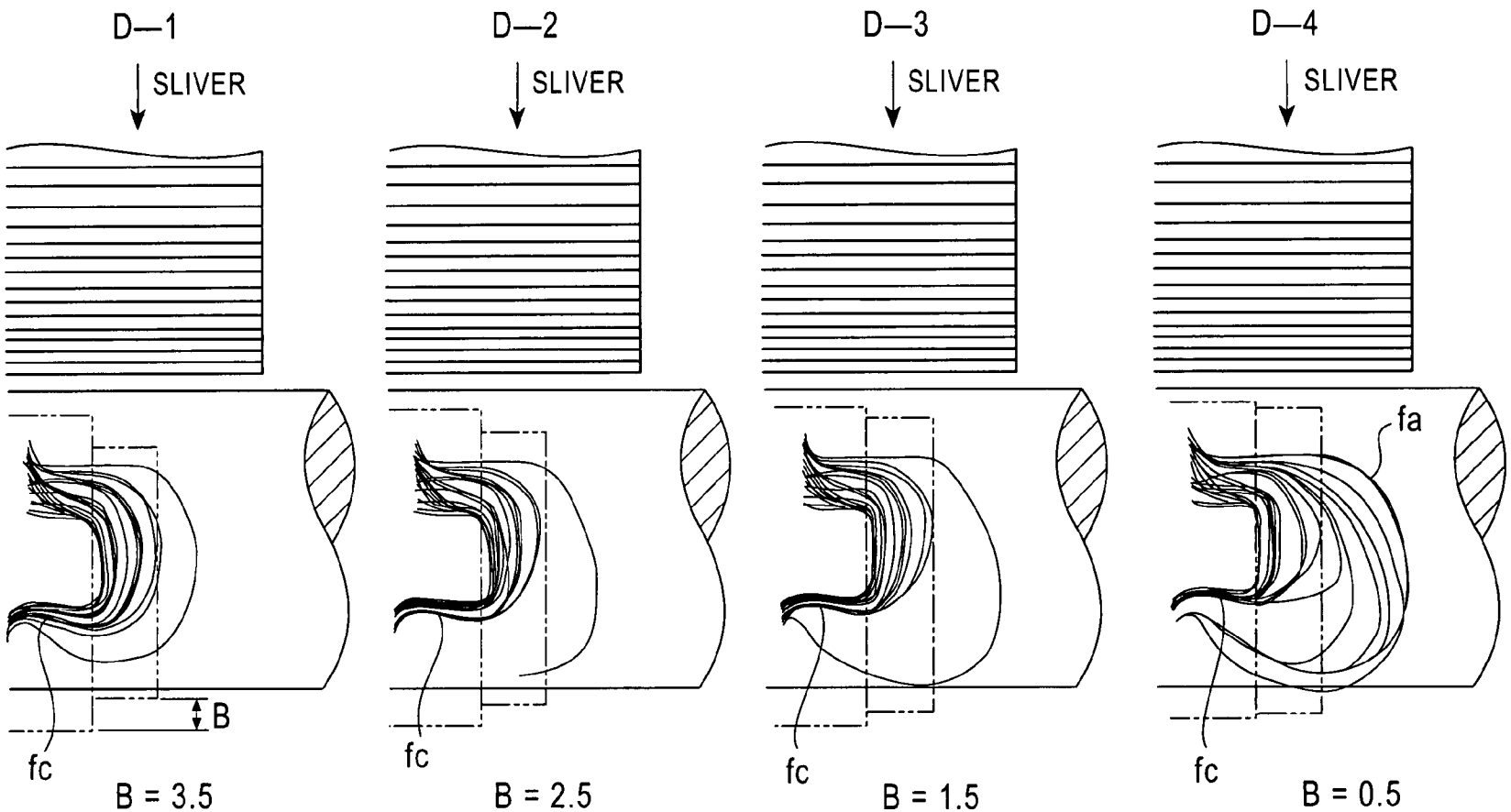
FIG. 9 is a view of the results of simulation of air flows in which the suction force of a spinning nozzle SN is taken into account.

FIGS. 8 and 9 show the results of simulation based on the numeral analysis of air flows. FIG. 8 shows the results of simulation of associated air currents resulting from the front roller Rf, which rotates at high speed. FIG. 9 shows the results of simulation of air flows in which the suction force of the spinning nozzle SN is taken into account.

In FIG. 8, C-1 shows the results of simulation in which the steps have a clearance B of 3.5 mm. C-2 shows the results of simulation in which the steps have a clearance B of 2.5 m. C-3 shows the results of simulation in which the steps have a clearance B of 1.5 mm. C-4 shows the results of simulation in which the steps have a clearance B of 0.5 mm. Further, in all cases, the width of the clearance is set at 7 mm.

In C-4, in which the clearance B is 0.5 mm, many of the associated air currents are air currents fa escaping in the horizontal direction, while there are few air currents fb flowing in the feeding direction of the sliver. In C-3, in which the clearance B is 1.5 mm, there are very few air currents fa escaping in the horizontal direction, while there are many air currents fb flowing in the feeding direction of the sliver. In this case, some of the associated air currents are associated currents fc resulting from the rotation of the roller. Further, in C-2 and C-1, there are few air currents fa escaping in the horizontal direction, while the number of associated currents fc resulting from the rotation of the roller increases.

In FIG. 9, in addition to the conditions used in FIG. 8, the suction force of the spinning nozzle SN is taken into account. In all the cases, there are many fast air currents fc flowing toward the nozzle. However, when the clearance is 0.5 mm as shown in D-4, there are still many air currents fa escaping in the horizontal direction, while there are few air currents fc flowing toward the nozzle.

The above results of simulation also indicate that problems occur both when the clearance B is too small and when it is too large and that the optimum clearance B is about 1.5 mm.

As described above, the draft device according to the present invention prevents a sliver fed while being drafted from being diffused and disturbed by associated air currents generated around the peripheral surface of a fast rotating front roller even when spinning is carried out at high speed. To accomplish this, the draft device according to the present invention comprises a front top roller in which steps deflecting and converting associated air currents into air currents flowing in the feeding direction of a sliver are formed, the roller having a predetermined rubber thickness. As a result, the draft device has a gripping force insufficient to cause draft unevenness.

Moreover, in the draft device, the steps are formed in the front top roller made of rubber. Therefore, not only machining but also a replacing operation are facilitated.

The invention claimed is:

1. A draft device comprising a plurality of roller pairs that pull a bundle of fibers while feeding the bundle downstream, wherein gaps are provided at ends of roller constituting roller pair, which are passed through associated air currents resulting from rotation of the roller and form air passages in which said air currents act as air flows forming a prevention wall that hinders spread of the bundle of fibers fed while being drafted, said gaps formed by steps in one of the rollers constituting the roller pair, and have a clearance of at least 1 mm and at most 3 mm and a width of at least 6 mm.

2. A draft device comprising a plurality of roller pairs that pull a bundle of fibers while feeding the bundle downstream, wherein gaps are provided at ends of roller constituting roller pair, which are passed through associated air currents resulting from rotation of the roller and form air passages in which said air currents act as air flows forming a prevention wall that hinders spread of the bundle of fibers fed while being drafted, the roller in which said gaps are formed is a rubber roller having a rubber thickness of at least 3.5 mm, and steps of height about 1.5 mm and width about 7 mm are formed at respective ends of the roller.

3. A draft device according to any of claims 1 or 2, wherein said draft device is a roller draft device applied to a spinning machine comprising a pneumatic spinning section that generates a spun yarn using whirling air currents.

* * * * *